US006979950B2

(12) United States Patent
Naoi et al.

(10) Patent No.: US 6,979,950 B2
(45) Date of Patent: Dec. 27, 2005

(54) PLASMA DISPLAY PANEL CONFIGURED TO SUBSTANTIALLY BLOCK THE REFLECTION OF LIGHT WHICH ENTERS A NON-LIGHT EMISSION AREA OF THE PLASMA DISPLAY PANEL

(75) Inventors: Taro Naoi, Yamanashi-ken (JP); Hirofumi Higashi, Yamanashi-ken (JP); Shingo Ogane, Yamanashi-ken (JP); Hiroaki Watanabe, Yamanashi-ken (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 0 days.

(21) Appl. No.: 10/673,158

(22) Filed: Sep. 30, 2003

(65) Prior Publication Data

US 2004/0189203 A1 Sep. 30, 2004

(30) Foreign Application Priority Data

Apr. 10, 2002 (JP) ..... 2002-291816

(51) Int. Cl.[7] ..... H01J 17/49
(52) U.S. Cl. ..... 313/587; 313/582; 313/586
(58) Field of Search ..... 313/582–587

(56) References Cited

U.S. PATENT DOCUMENTS

| | | | | |
|---|---|---|---|---|
| 6,614,183 | B2 * | 9/2003 | Masuda et al. | 313/586 |
| 6,674,238 | B2 * | 1/2004 | Otani et al. | 313/587 |
| 2002/0021090 | A1 * | 2/2002 | Sano et al. | 313/587 |
| 2003/0141817 | A1 * | 7/2003 | Shinoda et al. | 313/587 |
| 2004/0124775 | A1 * | 7/2004 | Okada et al. | 313/587 |

FOREIGN PATENT DOCUMENTS

JP 2000-311612 11/2000

* cited by examiner

*Primary Examiner*—Nimeshkumar D. Patel
*Assistant Examiner*—Matt Hodges
(74) *Attorney, Agent, or Firm*—Arent Fox PLLC

(57) ABSTRACT

A plurality of row electrode pairs and a dielectric layer are formed on a front glass substrate. A plurality of column electrodes forming discharge cells at the intersections with the row electrode pairs in a discharge space is formed on one of a back glass substrate and the front glass substrate. Each of the discharge cells is defined and separated from another discharge cell adjacent thereto in the column direction by a transverse wall of the partition wall provided between the front glass substrate and the back glass substrate. A black- or dark-colored light absorption layer facing the front glass substrate is formed in each non-light emission area including the transverse walls in the discharge space.

6 Claims, 6 Drawing Sheets

SECTION VA-VA

SECTION VB-VB

SECTION V2-V2

SECTION V3-V3

PLASMA DISPLAY PANEL CONFIGURED TO SUBSTANTIALLY BLOCK THE REFLECTION OF LIGHT WHICH ENTERS A NON-LIGHT EMISSION AREA OF THE PLASMA DISPLAY PANEL

BACKGROUND OF THE INVENTION

1. Field of the Invention

This invention relates to a cell structure for plasma display panels.

The present application claims priority from Japanese Application No. 2002-291816, the disclosure of which is incorporated herein by reference.

2. Description of the Related Art

In recent years, plasma display panels (hereinafter referred to as "PDP") have been spotlighted as a large-sized flat color-screen display and the widespread proliferation thereof in ordinary homes and the like has been planned.

FIG. 1 to FIG. 3 illustrate the cell structure of a conventional PDP.

FIG. 1 is a schematic plan view illustrating the cell structure of the conventional PDP. FIG. 2 is a sectional view taken along the VA—VA line in FIG. 1. FIG. 3 is a sectional view taken along the VB—VB line.

The conventional PDP has a front glass substrate 1 serving as the display screen and having a back surface on which a plurality of row electrode pairs (X, Y) each forming a display line L are arranged in parallel and extend in the row direction (the right-left direction in FIG. 1) of the front glass substrate 1.

Each of the row electrodes X and Y is constituted of transparent electrodes Xa (Ya) each formed of a T-shaped transparent conductive film made of ITO or the like, and a metal-film-made bus electrode Xb (Yb) extending in the row direction of the front glass substrate 1 and connected to the narrow proximal ends (i.e. the foot of the T shape) of the transparent electrodes Xa (Ya).

The row electrodes X and Y are regularly arranged in alternate positions in the column direction (the vertical direction in FIG. 1) of the front glass substrate 1. Then the transparent electrodes Xa and Ya, which are regularly lined up along the corresponding bus electrodes Xb and Yb to be opposite to each other, extend toward each other so that the widen top edges of the opposing transparent electrodes Xa and Ya face each other with a discharge gap g set at a required distance in between.

Each of the bus electrodes Xb, Yb is formed in a double layer construction consisting of a black conductive layer Xb1 (Yb1) positioned close to the display screen and a main conductive layer Xb2 (Yb2) positioned behind this.

On the back surface of the front glass substrate 1, a black-or dark-colored light absorption layer BS extends in parallel in the row direction between the back-to-back positioned bus electrodes Xb, Yb of the respective row electrode pairs (X, Y) adjacent to each other in the column direction.

In addition, on the back surface of the front glass substrate 1, a dielectric layer 2 is formed so as to cover the row electrode pairs (X, Y). On the back surface of the dielectric layer 2, additional dielectric layers 2A protrude backward from the dielectric layer 2, and each extend in parallel to the bus electrodes Xb, Yb in a position opposite the adjacent bus electrodes Xb and Yb of the respective row electrode pairs (X, Y) positioned alongside each other, and opposite the area between the adjacent bus electrode Xb and bus electrode Yb.

An MgO protective layer 3 is formed on the back surfaces of the dielectric layers 2 and the additional dielectric layers 2A.

In turn, a back glass substrate 4 placed in parallel to the front glass substrate 1 has a surface, facing toward the display screen, on which column electrodes D are arranged in parallel to each other at predetermined intervals and each extends opposite the paired transparent electrodes Xa and Ya of each row electrode pair (X, Y) in a direction at right angles to the row electrode pairs (X, Y) (i.e. the column direction).

On the surface of the back glass substrate 4 facing toward the display screen, a white-colored column-electrode protective layer (dielectric layer) 5 is further formed and covers the column electrodes D, and white-colored partition walls 6 are formed on the column-electrode protective layer 5.

Each of the partition walls 6 is shaped in a ladder pattern formed of a pair of transverse walls 6A extending in the row direction in positions respectively opposite to the bus electrodes Xb and Yb in each row electrode pair (X, Y), and a plurality of vertical walls 6B each extending in the column direction between the paired transverse walls 6A and at a midpoint between the adjacent column electrodes D.

The ladder-patterned partition walls 6 are arranged in parallel to each other in such a manner as to form an interstice SL opposite the light absorption layer BS and between the adjacent transverse walls 6A of the respective partition walls 6 positioned alongside each other in the column direction.

The ladder-patterned partition walls 6 partition a discharge space S defined between the front glass substrate 1 and the back glass substrate 2 into areas each opposite to the paired transparent electrodes Xa and Ya in each row electrode pair (X, Y) to form quadrangular discharge cells C.

Inside each of the discharge cells C, a phosphor layer 7 covers five faces, namely, the face of the column-electrode protective layer 5 and the four side faces of the transverse walls 6A and the vertical walls 6B of the partition wall 6. One of the three colors, red, green and blue, is applied in turn to the individual phosphor layer 7 so that the red, green and blue colors in the individual discharge cells C are arranged in order in the row direction.

The discharge space S is filled with a discharge gas.

To display an image in the conventional PDP, addressing takes place initially in order to selectively cause a discharge between one row electrode in the row electrode pair (X, Y) and the column electrode D in each discharge cell C for distribution of the lighted cells (discharge cells C having wall charges generated on the dielectric layer 2) and the non-lighted cells (discharge cells C having no wall charges generated on the dielectric layer 2) in all the display lines L over the panel surface in accordance with the image to be displayed.

After completion of the addressing, simultaneously in all the display lines L, a discharge-sustaining pulse is applied alternately to the row electrodes X and Y of each row electrode pair (X, Y) to trigger a surface discharge in each lighted cell with every application of the discharge-sustaining pulse. This surface discharge generates ultraviolet light which then excites each of the red-, green-, and blue-colored phosphor layers 7 formed in the individual lighted cells C to emit visible light for the generation of the image to be displayed.

The conventional PDP structured as described above has black-colored conductive layers Xb1, Yb1 formed on the respective bus electrodes Xb, Yb, and the black- or dark-colored light absorption layer BS formed between the bus electrodes Xb and Yb backing on each other in between the display lines L, in order to prevent reflection of ambient light incident to the panel's non-light emission area formed between the display lines L for achievement of improvement in image contrast on the panel surface.

Further, the above conventional PDP has a white color applied to the column-electrode protective layer 5 and the partition wall 6 which are formed on the back glass substrate 4 to cause the light emitted from the phosphor layer 7 and then travelling toward the back glass substrate 4 to reflect toward the front glass substrate 1, in order to enhance the use efficiency of the light for improvement in brightness of the image displayed on the panel screen.

However, in the conventional PDPs having such cell structure, ambient light entering at an angle from the light emission area (the area in which the discharge cells C is formed) of the panel screen may not be blocked by the black conductive layers Xb1, Yb1 of the row electrodes X, Y and the light absorption layer BS, and then may reach inside the interstice SL in the non-light emission area, and may possibly be reflected by the white column-electrode protective layer 5 and partition wall 6 which face the interstice SL. Thus, the reflection of the ambient light coming from the non-light emission area makes it impossible to prevent a decrease in contrast of an image displayed on the panel screen.

SUMMARY OF THE INVENTION

The present invention has been made to solve the problem associated with the conventional plasma display panel as described above.

It accordingly is an object of the present invention to provide PDPs capable of virtually completely blocking the reflection of ambient light which has entered a non-light emission area of the PDP, for the improved contrast of an image displayed on the panel screen.

To attain the above object, a plasma display panel according to the present invention includes: a front substrate and a back substrate which are opposite each other with a discharge space in between; a plurality of row electrode pairs regularly arranged in a column direction on the front substrate and each extending in a row direction to form a display line; a dielectric layer formed on the front substrate and covering the row electrode pairs; a plurality of column electrodes regularly arranged in the row direction on one of the back substrate and the front substrate and each extending in the column direction to form unit light-emission areas at intersections with the row electrode pairs in the discharge space; and partition walls provided between the front substrate and the back substrate and having transverse walls each extending in the row direction and defining and separating the unit light-emission areas adjacent to each other in the column direction from each other, and the plasma display panel has a feature of including a black- or dark-colored light absorption layer facing the front substrate and formed in each area including the transverse walls between the unit light-emission areas adjacent to each other in the column direction in the discharge space.

In the above PDP, each of the unit light-emission areas is formed in the discharge space at each intersection of the row electrode pair and the column electrode. Each of the unit light-emission areas is defined and separated from another unit light-emission area adjacent thereto in the column direction by the transverse wall, extending in the row direction, of the partition wall provided inside the discharge space.

In the non-light emission area of the panel including the transverse wall between the adjacent unit light-emission areas in the column direction, a black- or dark-colored light absorption layer is formed facing toward the front substrate.

For example, the light absorption layer is formed, in between the adjacent unit light-emission areas in the column direction, within the interstice between the adjacent transverse walls respectively partitioning off the unit light-emission areas or on the face of the transverse wall opposite the front substrate.

The PDP according to the present invention has the structure as described above, whereby even when ambient light enters the non-light emission area between the display lines on the panel, the light is absorbed by the light absorption layer formed, facing toward the front substrate, in the non-light emission area in the discharge space, and therefore becomes impossible to reflect toward the front substrate.

In consequence, even when, for example, the partition wall and/or any element formed on the back substrate are formed of white-colored materials in order to enhance the brightness in the light-emission area on the panel, the PDP is capable of achieving improved contrast of images displayed on its screen without impairment caused by the reflection of the ambient light coming from the non-light emission area.

These and other objects and features of the present invention will become more apparent from the following detailed description with reference to the accompanying drawings.

DETAILED DESCRIPTION OF THE PREFERRED EMBODIMENTS

Preferred embodiments according to the present invention will be described below in detail with reference to the accompanying drawings.

Figure 4:
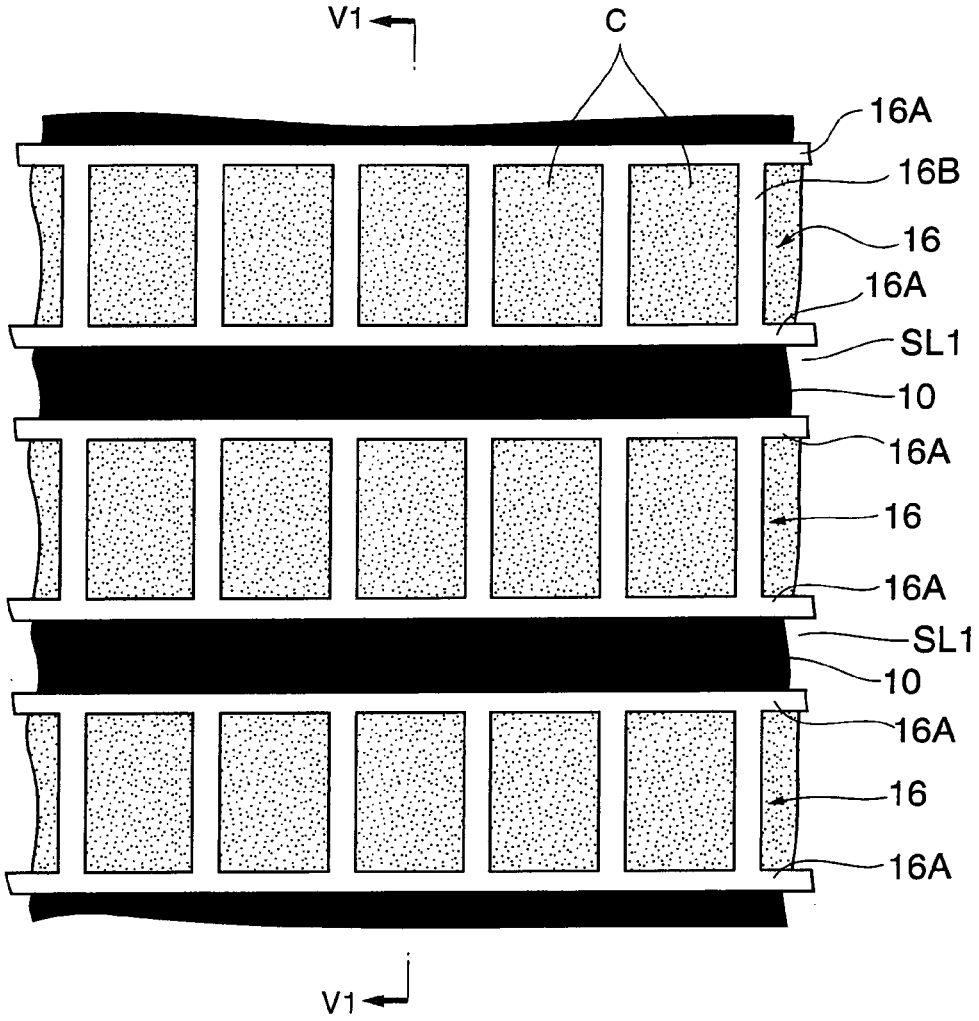
FIG. 4 is a schematic plan view illustrating a first embodiment according to the present invention.
Figure 5:
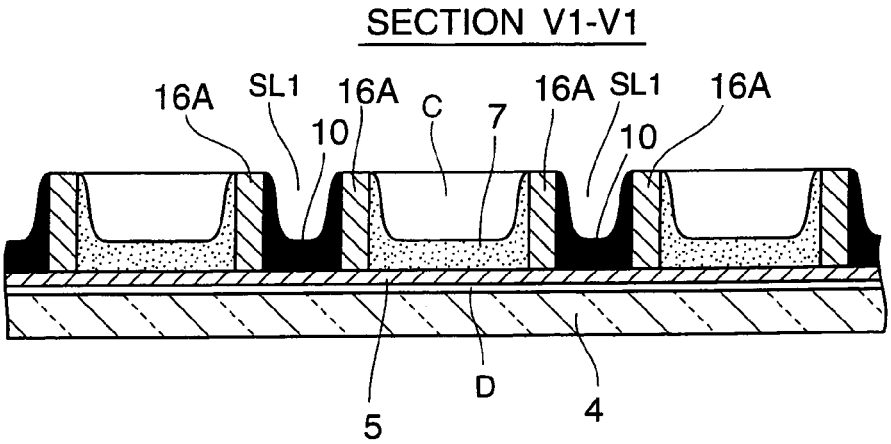
FIG. 5 is a sectional view taken along the V1—V1 line in FIG. 4.

FIG. 4 and FIG. 5 illustrate a first embodiment of a plasma display panel (PDP) according to the present invention.

FIG. 4 is a plan view illustrating the structure of a back glass substrate of the PDP in the first embodiment. FIG. 5 is a sectional view taken along the V1—V1 line in FIG. 4.

Figure 1:
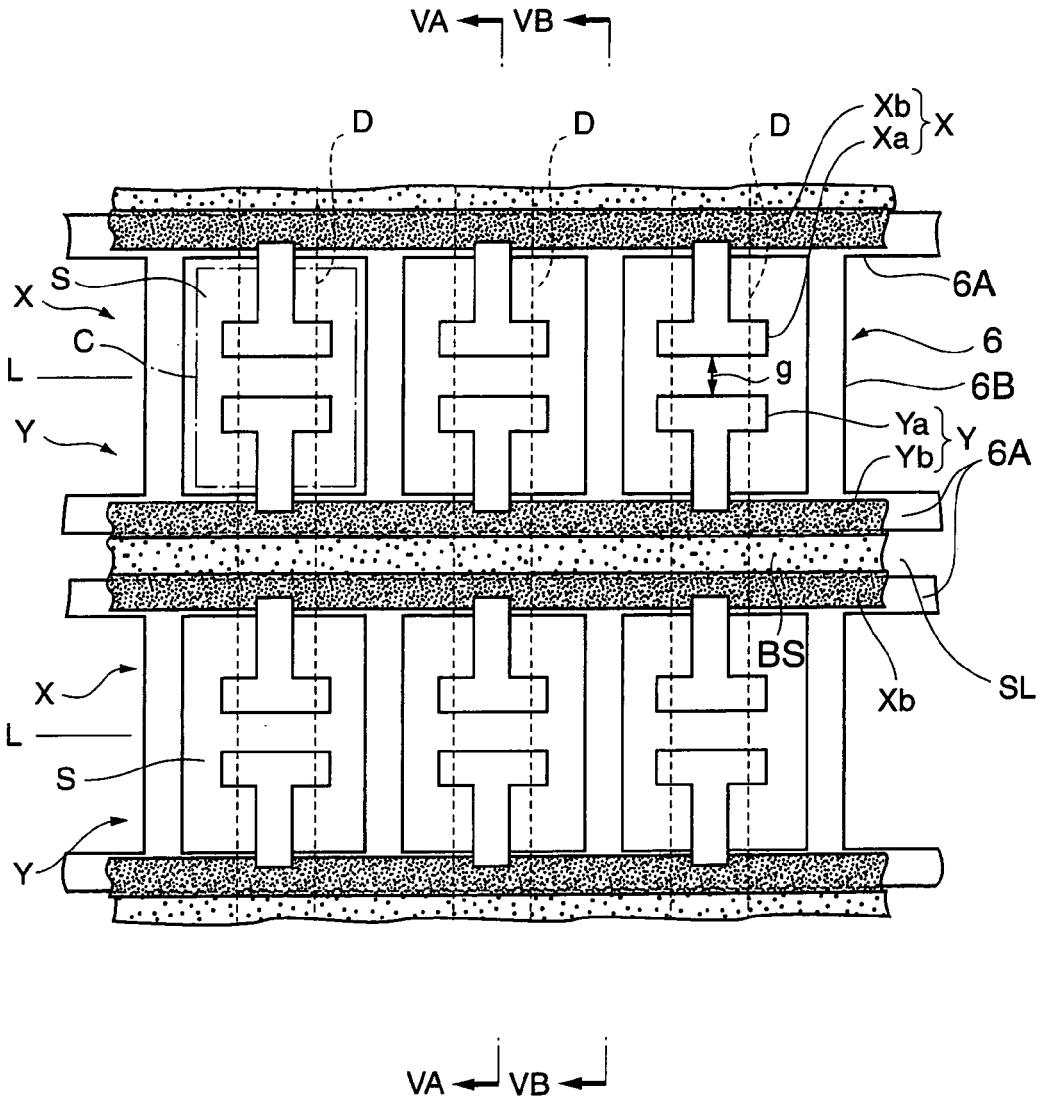
Fig.1 PRIOR ART
FIG. 1 is a schematic plan view illustrating the structure of a conventional PDP.
Figure 2:
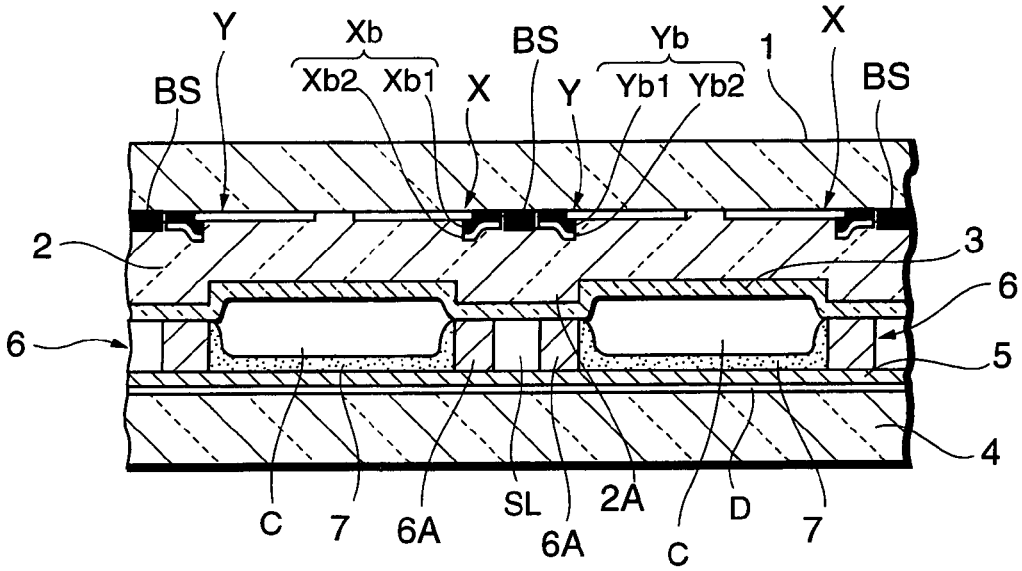
Fig.2 PRIOR ART
FIG. 2 is a sectional view taken along the VA—VA line in FIG. 1.
Figure 3:
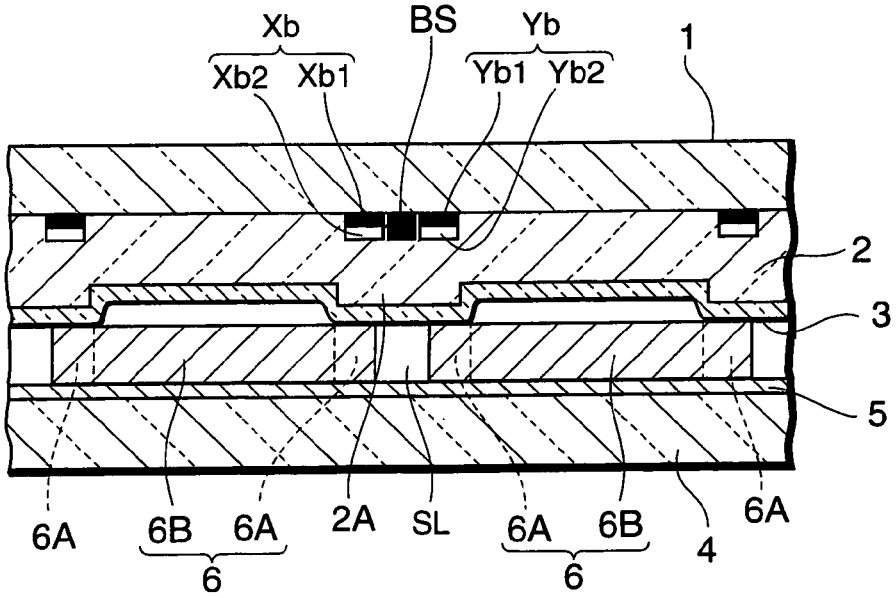
Fig.3 PRIOR ART
FIG. 3 is a sectional view taken along the VB—VB line in FIG. 1.

Regarding the structure of partition walls illustrated in FIGS. 4 and 5, as in the case of the conventional PDP described in FIGS. 1 to 3, each of the partition walls 16 is shaped in a ladder pattern formed of a pair of transverse walls 16A arranged in parallel to each other at required regular intervals and each extending in the row direction, and a plurality of vertical walls 16B arranged in parallel to each other at required regular intervals and each extending in the column direction between the paired transverse walls 16A. The partition walls 16 are arranged in parallel to each other in such a manner as to form an interstice SL1 extending in the row direction between the adjacent transverse walls 16A of the respective partition walls 16 positioned alongside each other in the column direction.

It should be noted that the same elements illustrated in FIGS. 4 and 5 as those in the conventional PDP shown in FIGS. 1 to 3 are designated with the same reference numerals.

The PDP in the embodiment is identical in structure on a front glass substrate (not shown) side to the PDP described in FIGS. 1 to 3. That is, a black-colored conductive layer is formed on a bus electrode of each row electrode, and also a light absorption layer is formed between the bus electrodes backing on each other in the column direction. Hence, when viewed from the front of the front glass substrate, the light absorption layers cover an area (a non-light emission area) including the back-to-back transverse walls 16A of the respective partition walls 16 positioned alongside each other, and the interstice SL1 formed between the back-to-back transverse walls 16A.

Inside the interstice SL1 between the back-to-back transverse walls 16A of the respective partition walls 16 adjacent to each other in the column direction, parts of the column-electrode protective layer 5 and transverse walls 16A which face the interstice SL1 is coated with a black- or dark-colored light absorption layer 10.

In this way, the light absorption layer 10 covers all the interior faces of the interstice SL1 which is positioned in the non-light emission area between the display lines of the panel. For this reason, even if light incident from the light emission area of the panel reaches the inside of the interstice SL1, the PDP is capable of preventing the light from being reflected in the interstice SL1 to exit from the light emission area of the panel toward the outside.

It accordingly is possible to prevent impairment of the image contrast on the panel screen due to the reflection of the ambient light coming from the non-light emission area, even when the partition wall 16 and/or the column-electrode protective layer 5, for example, are formed of white-colored materials for improvement in brightness in the light emission area of the panel.

In the first embodiment, if a light absorption layer is formed also on the top face of the transverse wall 16A facing the front glass substrate, the PDP is able to virtually completely block the reflection of the ambient light which has entered the non-light emission area. This makes it possible to omit the formation of the light absorption layer (the black conductive layer on the bus electrode and the light absorption layer formed between the bus electrodes) on the front glass substrate.

Figure 6:
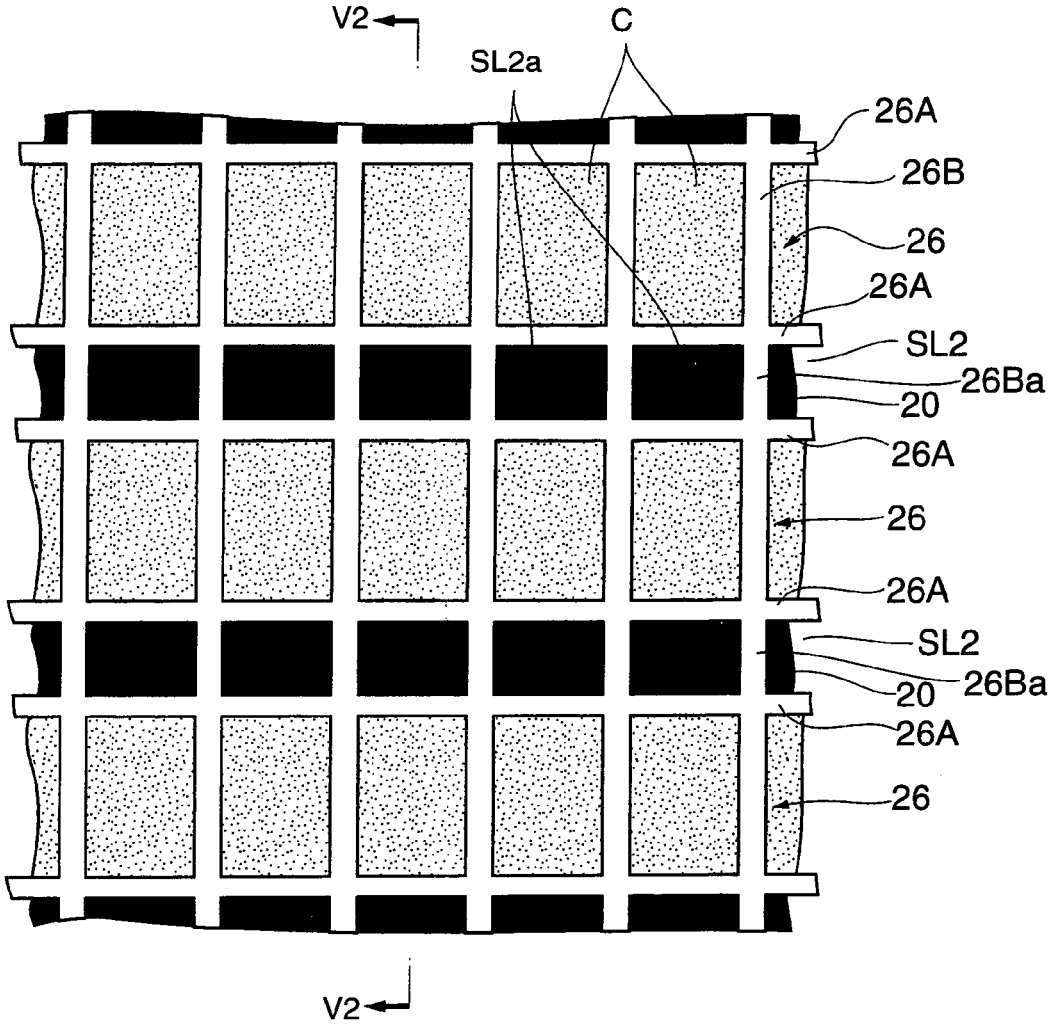
FIG. 6 is a schematic plan view illustrating a second embodiment according to the present invention.
Figure 7:
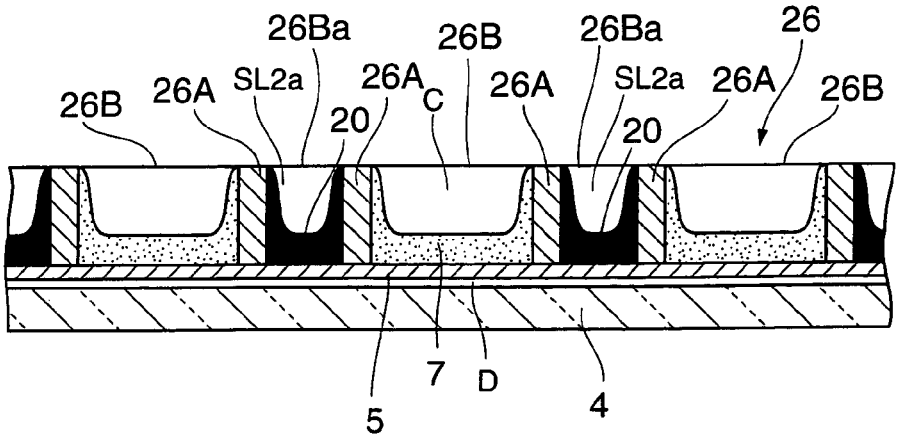
FIG. 7 is a sectional view taken along the V2—V2 line in FIG. 6.

FIG. 6 and FIG. 7 illustrate a second embodiment of the plasma display panel (PDP) according to the present invention. FIG. 6 is a plan view illustrating the structure of a back glass substrate of the PDP according to the second embodiment. FIG. 7 is a sectional view taken along the V2—V2 line in FIG. 6.

The PDP in the second embodiment has partition walls 26. As in the case of the partition wall 16 of the PDP described in the first embodiment, the partition wall 26 is constituted of a pair of transverse walls 26A each extending in the row direction, and a plurality of vertical walls 26B arranged in parallel at required regular intervals and each extending in the column direction between the paired transverse walls 26A. The partition walls 26 are arranged in parallel to each other in the column direction in such a manner as to form an interstice SL2 between the two partition walls 26 positioned alongside each other.

The vertical walls 26B of the respective partition walls 26 are coupled to each other by a wall portion 26Ba extending through the interstice SL2 in the column direction such that the vertical walls 26B continuously extend in the column direction. The wall portions 26Ba partition off the interstice SL2 at regular intervals in the row direction.

The structure relating to the other elements in the second embodiment is the same as that of the PDP in the first embodiment. Therefore the same elements as those in the first embodiment are designated with the same reference numerals.

In the second embodiment, inside each of the partitioned parts SL2*a* into which the interstice SL2 is partitioned off by the wall portions 26Ba, a black- or dark-colored light absorption layer 20 is formed and covers parts of the column-electrode protective layer 5, transverse walls 26A and wall portions 26Ba which face the partitioned part SL2*a*.

The light absorption layer 20 covers the interior faces of each partitioned part SL2*a* of the interstice SL2 which is positioned in the non-light emission area between the display lines of the panel. For this reason, even if light incident from the light emission area of the panel reaches the inside of the partitioned part SL2*a* of the interstice SL2, the PDP is capable of preventing the light from being reflected in the partitioned part SL2*a* to exit from the light emission area of the panel toward the outside.

In the second embodiment, if a light absorption layer is formed also on the top faces (opposite to the front glass substrate) of the transverse wall 26A and the wall portion 26Ba partitioning the interstice SL2, the PDP is able to virtually completely block the reflection of the ambient light which has entered the non-light emission area. This makes it possible to omit the formation of the light absorption layer (the black conductive layer on the bus electrode and the light absorption layer formed between the bus electrodes) on the front glass substrate.

Figure 8:
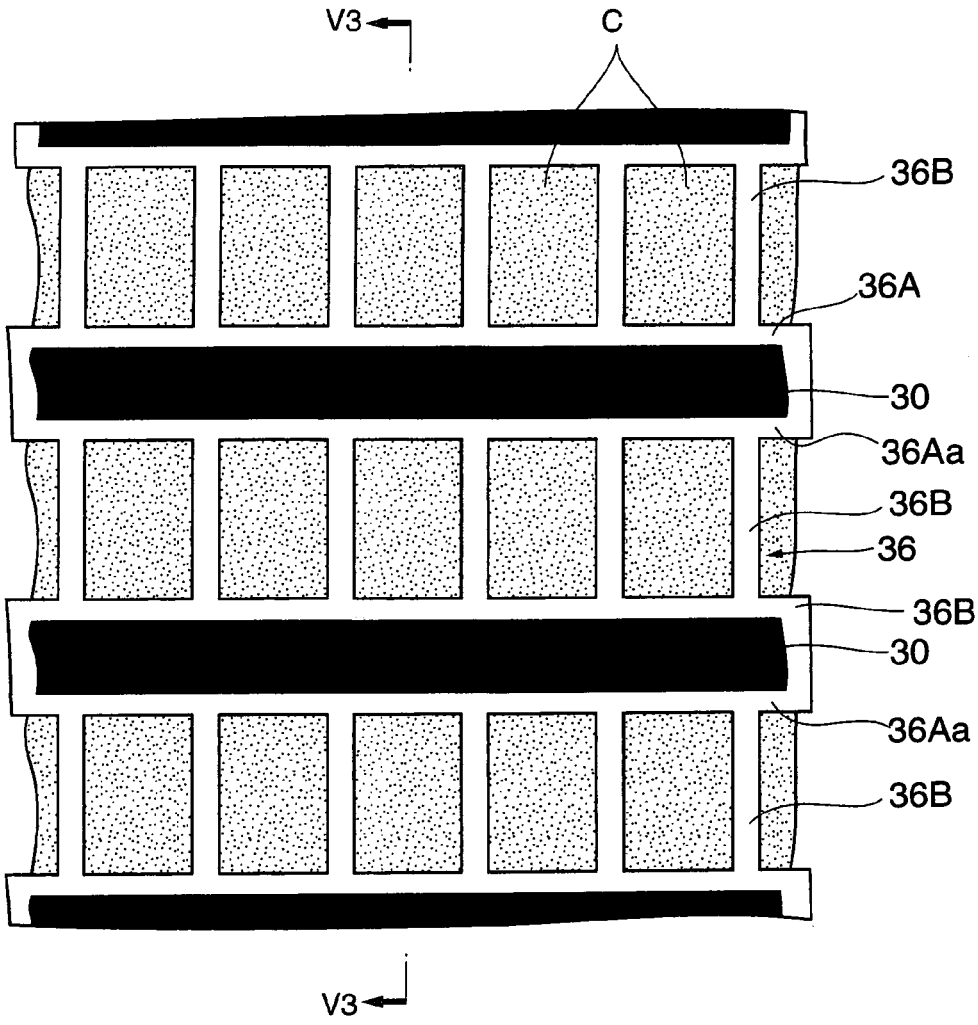
FIG. 8 is a schematic plan view illustrating a third embodiment according to the present invention.
Figure 9:
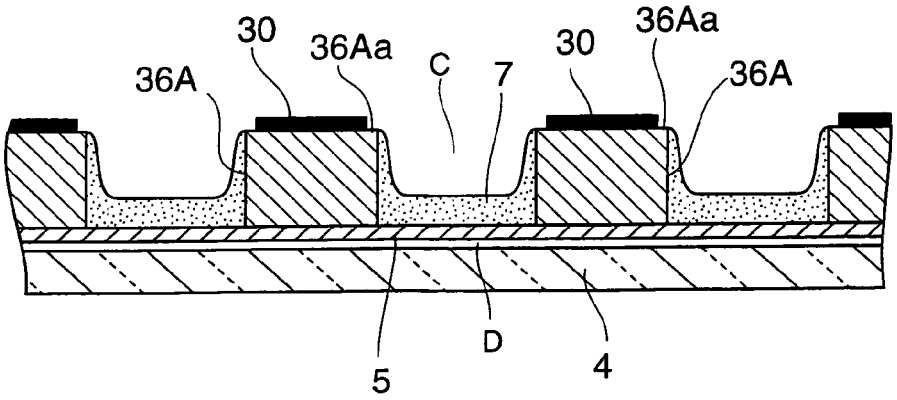
FIG. 9 is a sectional view taken along the V3—V3 line in FIG. 8.

FIG. 8 and FIG. 9 illustrate a third embodiment of the plasma display panel (PDP) according to the present invention. FIG. 8 is a plan view illustrating the structure of a back glass substrate of the PDP according to the third embodiment. FIG. 9 is a sectional view taken along the V3—V3 line in FIG. 8.

The PDP in the third embodiment has a partition wall 36 which is shaped in a grid pattern formed of transverse walls 36A each extending between the adjacent display lines in the row direction, and vertical walls 36B arranged in parallel at required regular intervals and each extending in the column direction. The PDP in the third embodiment has no interstice formed between the adjacent display lines, unlike the cases of the PDPs in the first and second embodiments.

The structure relating to the other elements in the third embodiment is similar to that of the PDP in the first embodiment. Therefore the same elements as those in the first embodiment are designated with the same reference numerals.

The PDP in the third embodiment has a belt-shaped light absorption layer 30 extending on a top face 36Aa of the transverse wall 36A in the row direction.

The light absorption layer 30 covers the top face 36Aa of the transverse wall 36A facing toward the front glass substrate in the non-light emission area of the panel. For this reason, even if light incident from the light emission area of the panel reaches any part of the non-light emission area in which the transverse wall 36A is positioned, the PDP is capable of preventing the light from being reflected by the transverse wall 36A to exit from the light emission area of the panel toward the outside.

The formation of the light absorption layer 30 makes it possible to omit the formation of the light absorption layer (the black conductive layer on the bus electrode and the light absorption layer formed between the bus electrodes) on the front glass substrate.

Figure 10:
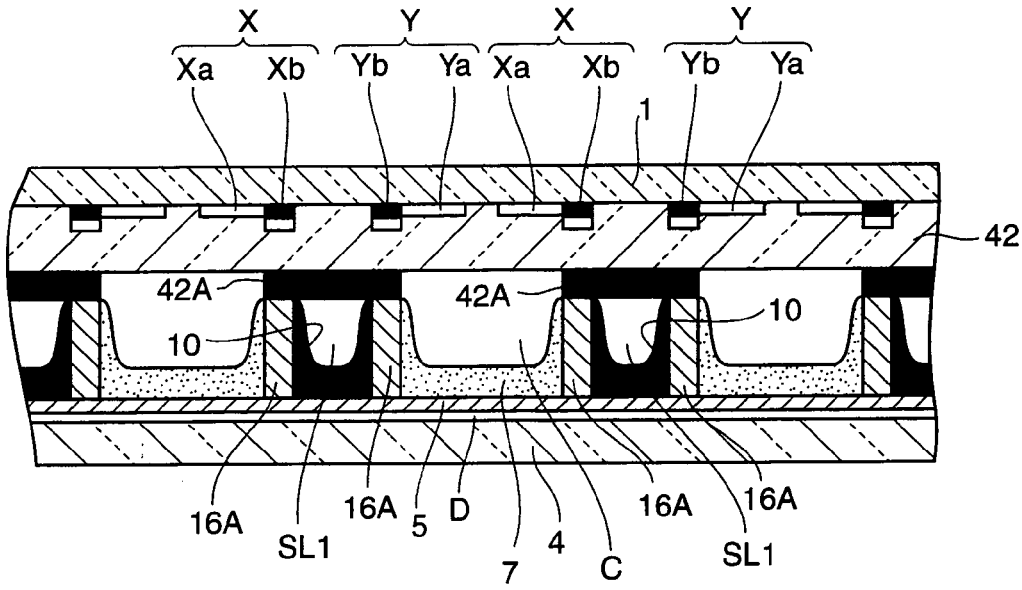
FIG. 10 is a schematic plan view illustrating a fourth embodiment according to the present invention.

FIG. 10 is a sectional view illustrating a fourth embodiment of the plasma display panel (PDP) according to the present invention, which is taken along the same line as that in FIG. 5 of the first embodiment.

The PDP in the fourth embodiment has an additional dielectric layer 42A constituted of a black- or dark-colored light absorption layer. Each of the additional dielectric layers 42A is formed on the back face of a dielectric layer 42 covering the row electrode pairs (X, Y) on the front glass substrate 1, in a position opposite the adjacent bus electrodes Xb and Yb of the respective row electrode pairs (X, Y) positioned alongside each other, and opposite the area between the adjacent bus electrodes Xb and Yb concerned, and extends in parallel to the bus electrodes Xb and Yb. The additional dielectric layer 42A is opposite to the back-to-back transverse walls 16A of the respective partition walls 16 and also to the interstice SL1 interposed between the transverse walls 16A concerned.

The structure relating to the other elements in the fourth embodiment is similar to those of the PDPs in the first embodiment and the conventional example described in Description of the Related Art. Therefore the same elements as those in the first embodiment and the conventional example are designated with the same reference numerals, respectively.

In addition to the technical advantages of the PDP in the first embodiment, the PDP in the fourth embodiment is able to offer further close-to-perfect prevention of the reflection of the ambient light which has entered the non-light emission area of the panel, because the light absorption layer constitutes the additional dielectric layer 42A formed opposite the two back-to-back transverse walls 16A of the respective partition walls 16 and the interstice SL1 formed between the transverse walls 16A concerned to cover the non-light emission area between the adjacent display lines in which the transverse walls 16A and the corresponding interstice SL1 are placed.

Figure 11:
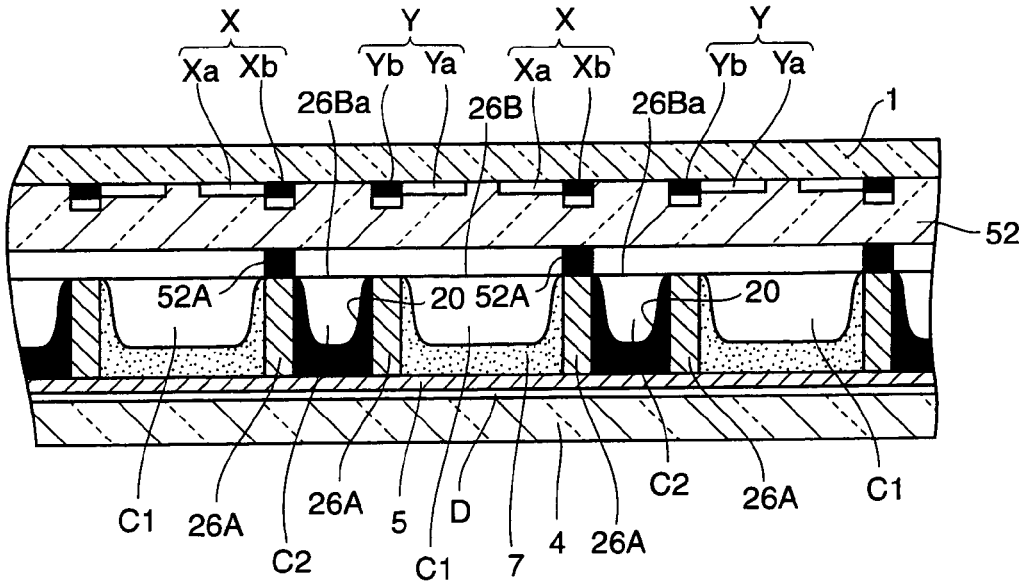
FIG. 11 is a schematic plan view illustrating a fifth embodiment according to the present invention.

FIG. 11 illustrates a sectional view of a fifth embodiment of the plasma display panel (PDP) according to the present invention, which is taken along the same line as that of FIG. 7 of the second embodiment.

A partition wall 26 of the PDP in the fifth embodiment has similar structure to that in the second embodiment. The interstice formed between the transverse walls 26A in between the adjacent display lines is partitioned at regular intervals by the wall portions 26Ba of the vertical walls 26B each extending in the column direction.

The PDP of the fifth embodiment includes spaces C2 each defined by the wall portions 26Ba partitioning the above interstice, and discharge cells C1 each formed opposite the paired transparent electrodes Xa and Ya in each row electrode pair (X, Y).

The space C2 and the discharge cell C1 adjacent to the space C2 concerned in the column direction are paired with each other so that the discharge cell C1 constitutes a display discharge cell for producing a sustaining emission discharge, and the space C2 constitutes an addressing discharge cell for producing an addressing discharge.

Each of additional dielectric layers 52A is formed opposite one of the two transverse walls 26A situated, in the column direction, on opposite sides of the space (addressing discharge cell) C2 defined in the interstice between the transverse walls 26A. The additional dielectric layer 52A extends in a belt shape in the row direction (a direction at right angles to FIG. 11), and protrudes from a dielectric layer 52, covering the row electrode pairs (X, Y), to come in contact with the transverse wall 26A.

With such design, a pair of the display discharge cell C1 and addressing discharge cell C2 is shielded from another pair of the cells C1 and C2 adjacent thereto in the column direction by the additional dielectric layer 52A.

The additional dielectric layer 52A is formed of a black- or dark-colored light absorption layer.

The structure relating to the other elements in the fifth embodiment is similar to those of the PDP in the second embodiment. Therefore the same elements as those in the second embodiment are designated with the same reference numerals.

In the fifth embodiment, the light absorption layer 20 is also formed in the addressing discharge cell C2. This makes it possible to prevent the reflection of the ambient light which has entered the inside of the addressing discharge cell C2. Moreover, the additional dielectric layer 52A is formed of the black- or dark-colored light absorption layer to make it possible to offer further close-to-perfect prevention of the reflection of the ambient light which has entered the non-light emission area of the panel in which the addressing discharge cell C2 is placed.

In the fifth embodiment, the light absorption layer 20 formed in the addressing discharge cell C2 may contain a material of a high coefficient of secondary electron emission, namely, a high $\gamma$ material of a low work function.

With the above design, the light absorption layer 20 blocks the reflection of the ambient light having entered the inside of the addressing discharge cell C2. In addition, due to the material having a high coefficient of secondary electron emission and contained in the light absorption layer 20, it is possible to reduce the discharge starting voltage for addressing discharge generated between the row electrode and the column electrode in the addressing discharge cell C2.

Examples of such materials having a high coefficient of secondary electron emission include a material having a work function of 4.2 eV or less, such as: oxides of alkali metals (e.g. $Cs_2O$: work function 2.3 eV); oxides of alkali-earth metals (e.g. CaO, SrO, BaO); fluorides (e.g. $CaF_2$, $MgF_2$); a material increased in a coefficient of secondary electron emission by means of imperfection levels produced in crystal by crystal defects, impurities, or the like (e.g. MgOx having a composition ratio of Mg:O changed from 1:1 to cause crystal defects); $TiO_2$; $Y_2O_3$; and so on.

The foregoing embodiments have described using the PDPs structured such that the column electrodes are provided on the back glass substrate, and yet the present invention is applicable to a PDP structured such that each of row electrode pairs and each of column electrodes are provided on the front glass substrate and form a right angle at a distance from each other.

The PDP in each of the aforementioned embodiments is embodied on the basis of a comprehensively general idea in which: a plasma display panel is structured such that a front substrate and a back substrate are opposite each other with a discharge space in between, a plurality of row electrode pairs are regularly arranged in a column direction and each extend in a row direction to form a display line, the plurality of row electrode pairs and a dielectric layer covering the row electrode pairs are formed on the front substrate, a plurality of column electrodes are regularly arranged on one of the back substrate and the front substrate in the row direction and each extend in the column direction to form unit light-emission areas at the intersections with the row electrode pairs in the discharge space, and the adjacent unit light-emission areas in the column direction are defined and separated from each other by transverse walls (extending in the row direction) of partition walls provided between the front substrate and the back substrate, and in the PDP, a black- or dark-colored light absorption layer facing the front substrate is formed in each area including the transverse walls between the unit light-emission areas adjacent to each other in the column direction in the discharge space.

In the PDP based on the above comprehensively general idea, each of the unit light-emission areas is formed in the discharge space at the intersection of the row electrode pair and the column electrode, the transverse wall of the partition wall provided inside the discharge space extends in the row direction and defines and separates the unit light-emission areas adjacent to each other in the column direction from each other.

In the non-light emission area of the panel in which the transverse wall between the adjacent unit light-emission areas in the column direction is provided, a black- or dark-colored light absorption layer is formed facing toward the front substrate.

For example, the light absorption layer is formed, in between the adjacent unit light-emission areas in the column direction, within the interstice between the adjacent transverse walls respectively partitioning off the unit light-emission areas or on the face of the transverse wall opposite the front substrate.

By structuring the PDP as described above, even when ambient light enters the non-light emission area between the display lines on the panel, the light is absorbed by the light absorption layer formed, facing toward the front substrate, in the non-light emission area in the discharge space, and thus the reflection of the light toward the front substrate is prevented.

In consequence, even when, for example, the partition wall and/or any element formed on the back substrate are formed of white-colored materials in order to enhance the brightness in the light-emission area on the panel, the PDP is capable of achieving improved contrast of images displayed on its screen without impairment caused by the reflection of the ambient light coming from the non-light emission area.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including, a front substrate and a back substrate which are opposite each other with a discharge space in between, a plurality of row electrode pairs regularly arranged in a column direction on the front substrate and each extending in a row direction to form a display line, a dielectric layer formed on the front substrate and covering the row electrode pairs, a plurality of column electrodes regularly arranged in the row direction on one of the back substrate and the front substrate and each extending in the column direction to form unit light-emission areas at intersections with the row electrode pairs in the discharge space, and partition walls provided between the front substrate and the back substrate and having transverse walls each extending in the row direction and defining and separating the unit light-emission areas adjacent to each other in the column direction from each other, the plasma display panel comprising:

a black- or dark-colored light absorption layer facing the front substrate and formed in each area including the transverse walls between the unit light-emission areas adjacent to each other in the column direction in the discharge space, wherein in between the unit light-emission areas adjacent to each other in the column direction, the transverse walls partitioning off the corresponding unit light-emission areas are opposite each other with an interstice in between, and said light absorption layer is formed inside the interstice.

2. A plasma display panel according to claim 1, wherein the interstice is partitioned, by wall portions of the partition wall each extending in the column direction, into defined sections each arranged side by side with the corresponding unit light emission area in the column direction, and said light absorption layer is formed in each of the defined sections.

3. A plasma display panel according to claim 1, further comprising a black- or dark-colored additional part protruding into the discharge space from a portion of a back face of the dielectric layer opposite to the transverse walls and the interstice formed between the transverse walls concerned.

4. A plasma display panel according to claim 1, wherein each of the unit light emission areas forms a display discharge cell for light emission for generation of an image, and a defined section of the interstice is arranged side by side with the corresponding display discharge cell in the column direction and forms an addressing discharge cell for generating a discharge for selecting the display discharge cells from which light is to be emitted, further comprising a black- or dark-colored additional part protruding into the discharge space from a portion of a back face of the dielectric layer opposite to the transverse wall positioned between a pair of the display discharge cell and addressing discharge cell and another pair of the display discharge cell and addressing discharge cell adjacent thereto in the column direction.

5. A plasma display panel according to claim 4, wherein said light absorption layer formed in the addressing discharge cell contains a material of a high coefficient of secondary electron emission.

6. A plasma display panel according to claim 1, wherein, inside the interstice, a part of surface of the back substrate and the transverse walls which face the interstice are coated with said light absorption layer.

* * * * *